US009343876B2

(12) United States Patent
Yoshimoto et al.

(10) Patent No.: US 9,343,876 B2
(45) Date of Patent: May 17, 2016

(54) SPARK PLUG

(75) Inventors: Osamu Yoshimoto, Inazawa (JP); Takehito Kuno, Nagoya (JP); Tomoo Tanaka, Kitanagoya (JP); Tomonori Kanemaru, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 259 days.

(21) Appl. No.: 13/984,561

(22) PCT Filed: Feb. 13, 2012

(86) PCT No.: PCT/JP2012/000937
§ 371 (c)(1),
(2), (4) Date: Aug. 9, 2013

(87) PCT Pub. No.: WO2012/111303
PCT Pub. Date: Aug. 23, 2012

(65) Prior Publication Data

US 2013/0313962 A1 Nov. 28, 2013

(30) Foreign Application Priority Data

Feb. 15, 2011 (JP) ..... 2011-029414

(51) Int. Cl.
*H01T 13/06* (2006.01)
*C22C 19/05* (2006.01)
(Continued)

(52) U.S. Cl.
CPC ..... *H01T 13/06* (2013.01); *C22C 19/05* (2013.01); *H01T 13/20* (2013.01); *H01T 13/39* (2013.01)

(58) Field of Classification Search
CPC ..... C22C 19/05; H01T 13/06; H01T 13/20; H01T 13/39
See application file for complete search history.

(56) References Cited

U.S. PATENT DOCUMENTS 6,304,022 B1 10/2001 Matsutani ..... 313/141
6,603,244 B2 8/2003 Sugiyama et al. ..... 313/118
(Continued)

FOREIGN PATENT DOCUMENTS

EP 2270937 A1 1/2011 ..... H01T 13/20
JP 4073636 2/2008 ..... H01T 21/02
(Continued)

OTHER PUBLICATIONS

Office Action received in corresponding Chinese Patent Application No. 201280005512.6; dated Jul. 7, 2014 (English-language translation included).
(Continued)

*Primary Examiner* — Nimeshkumar Patel
*Assistant Examiner* — Jacob R Stern
(74) *Attorney, Agent, or Firm* — Kusner & Jaffe

(57) ABSTRACT

A spark plug including a center electrode; an insulator; a metallic shell; and a ground electrode, wherein at least one of the center electrode and the ground electrode has thereon an intermediate member which connects the center electrode or the ground electrode to a noble metal tip. The intermediate member has a tip-bonding portion to which the noble metal tip is bonded, and an electrode-bonding portion which has a diameter greater than that of the tip-bonding portion, and which is bonded to the center electrode or the ground electrode. The intermediate member contains nickel (Ni) as a main component, and also contains chromium (Cr) in an amount of 15 to 25 wt. %. The intermediate member contains, in a surface portion thereof, silicon (Si) in an amount per unit volume of 0.04 mg/mm$^3$ to 0.12 mg/mm$^3$, and aluminum (Al) in an amount per unit volume of 0.03 mg/mm$^3$ to 0.10 mg/mm$^3$.

14 Claims, 6 Drawing Sheets

(51) Int. Cl.
*H01T 13/20* (2006.01)
*H01T 13/39* (2006.01)

(56) References Cited

U.S. PATENT DOCUMENTS

| | | | | |
|---|---|---|---|---|
| 2008/0074025 | A1* | 3/2008 | Hori | 313/141 |
| 2010/0264802 | A1* | 10/2010 | Tanaka et al. | 313/141 |
| 2011/0043093 | A1 | 2/2011 | Nunome | 313/141 |
| 2011/0163653 | A1 | 7/2011 | Torii et al. | 313/141 |

FOREIGN PATENT DOCUMENTS

| | | | |
|---|---|---|---|
| JP | 2008-214734 | 9/2008 | C22C 19/05 |
| JP | 2009-158408 | 7/2009 | H01T 13/20 |
| JP | 2009-163923 | 7/2009 | H01T 13/20 |
| WO | WO 2010/029944 | 3/2010 | H01T 13/20 |

OTHER PUBLICATIONS

Form PCT/ISA/210—Int'l Search Report (from corresponding Int'l Patent App. No. PCT/JP2012/000937—1 page.

* cited by examiner

FIG. 3(A) EFFECT OF Al CONTENT AND Si CONTENT

| SAMPLE NO. | Se/St | Al CONTENT (mg/mm³) | Si CONTENT (mg/mm³) | RATING |
|---|---|---|---|---|
| 1 | 1.8 | 0.02 | 0.04 | × |
| 2 | 1.8 | 0.04 | 0.03 | × |
| 3 | 1.8 | 0.03 | 0.04 | O+ |
| 4 | 1.8 | 0.06 | 0.05 | O |
| 5 | 1.8 | 0.09 | 0.05 | O |
| 6 | 1.8 | 0.11 | 0.05 | × |
| 7 | 1.8 | 0.06 | 0.1 | O+ |
| 8 | 1.8 | 0.05 | 0.12 | O+ |
| 9 | 1.8 | 0.06 | 0.13 | × |

Ni=73wt%、Cr=25wt%、Fe≦500ppm、St=0.38mm²

FIG. 3(B) EFFECT OF Se/St

| SAMPLE NO. | Se/St | Al CONTENT (mg/mm³) | Si CONTENT (mg/mm³) | RATING |
|---|---|---|---|---|
| 3 | 1.8 | 0.03 | 0.04 | O+ |
| 10 | 2.5 | 0.03 | 0.04 | O++ |
| 4 | 1.8 | 0.06 | 0.05 | O |
| 11 | 2.7 | 0.06 | 0.05 | O+ |
| 5 | 1.8 | 0.09 | 0.05 | O |
| 12 | 2.5 | 0.09 | 0.05 | O+ |
| 13 | 3.4 | 0.09 | 0.05 | O+ |

Ni=73wt%、Cr=25wt%、Fe≦500ppm、St=0.38mm²

FIG. 4

EFFECT OF Se/St

| SAMPLE NO. | Se/St | Al CONTENT (mg/mm³) | Si CONTENT (mg/mm³) | RATING |
|---|---|---|---|---|
| 14 | 1.8 | 0.03 | 0.04 | O+ |
| 15 | 2.5 | 0.03 | 0.04 | O++ |
| 16 | 3.4 | 0.03 | 0.04 | O++ |

Ni=73wt%、Cr=25wt%、Fe≦500ppm、St=0.71mm²

Ni=73wt%、Cr=25wt%
Al=0.05mg/mm³、 Si=0.08mg/mm³

| SAMPLE NO. | TIP-BONDING PORTION DIAM.* (mm) | St (mm²) | Se/St | GAP INCREASE (mm) |
|---|---|---|---|---|
| 19 | 0. 4 | 0. 13 | 15. 9 | 0. 75 |
| 20 | 0. 5 | 0. 20 | 10. 2 | 0. 61 |
| 21 | 0. 7 | 0. 38 | 5. 2 | 0. 27 |
| 22 | 0. 9 | 0. 64 | 3. 1 | 0. 115 |
| 23 | 0. 95 | 0. 71 | 2. 8 | 0. 1 |

Ni=73wt%、Cr=25wt%、Fe≦500ppm
Al=0.075mg/mm³、Si=0.083mg/mm³、Se=2.0mm

* TRANSVERSE CROSS-SECTION

SPARK PLUG

FIELD OF THE INVENTION

The present invention relates to a spark plug.

BACKGROUND OF THE INVENTION

Heretofore, conventional spark plugs used, for example, in an internal combustion engine, a configuration in which a noble metal tip is provided on a distal end portion of a ground electrode via an intermediate member (see, for example, Japanese Patent Application Laid-Open (kokai) No. 2009-163923). (See also Japanese Patent Application Laid-Open (kokai) No. 2009-158408, Japanese Patent No. 4073636 and Japanese Patent Application Laid-Open (kokai) No. 2008-214734). In the case where a noble metal tip is provided on the ground electrode, when the ground electrode is located so as to be away from a discharge gap, flame-quenching effect, which the ground electrode deprives energy of a flame kernel generated through discharge, can be prevented. Therefore, in the case where the noble metal tip is bonded to the ground electrode, when an intermediate member is provided, the amount of the noble metal employed can be reduced, and a sufficient distance can be secured between the ground electrode and the discharge gap.

Although the aforementioned intermediate member is formed of, for example, a nickel alloy, which is generally known to have very high corrosion resistance, when the intermediate member is employed for a long period of time, the member may corrode to an unacceptable extent. Particularly, in the case of an intermediate member, which is provided in the vicinity of a discharge gap of a spark plug, corrosion due to cooling-heating cycles is likely to occur. Thus, demand has arisen for further improvement of the durability of a structure in which a noble metal tip is attached to a ground electrode via an intermediate member. Since attachment of a noble metal tip via an intermediate member may be applied not only to a ground electrode but also to a center electrode, the aforementioned problems may occur not only in the ground electrode but also in the center electrode.

The present invention has been accomplished for solving the aforementioned problems, and an object of the present invention is to improve the durability of a structure in which a noble metal tip is attached to a ground electrode or a center electrode via an intermediate member.

SUMMARY OF THE INVENTION

The present invention has been accomplished for solving the aforementioned problems at least partially, and may be carried out in the following modes or application examples.

APPLICATION EXAMPLE 1

In accordance with the present invention, there is provided a spark plug comprising:

a center electrode;

an insulator provided around the center electrode;

a metallic shell provided around the insulator; and a ground electrode which is provided such that one end thereof is bonded to the metallic shell, and the other end faces the center electrode, characterized in that:

at least one of the center electrode and the ground electrode has thereon an intermediate member which connects the center electrode or the ground electrode to a noble metal tip;

the intermediate member has a tip-bonding portion to which the noble metal tip is bonded, and an electrode-bonding portion which is adjacent to the tip-bonding portion, which has a diameter greater than that of the tip-bonding portion, and which is bonded to the center electrode or the ground electrode;

the intermediate member contains nickel (Ni) as a main component, and also contains chromium (Cr) in an amount of 15 to 25 wt. %; and the intermediate member contains, in a surface portion thereof, silicon (Si) in an amount per unit volume of 0.04 $mg/mm^3$ to 0.12 $mg/mm^3$, and aluminum (Al) in an amount per unit volume of 0.03 $mg/mm^3$ to 0.10 $mg/mm^3$.

In the spark plug according to application example 1, the intermediate member contains, in a surface portion thereof, silicon (Si) and aluminum (Al) in the aforementioned specific amounts per unit volume. Therefore, the intermediate member exhibits improved durability and corrosion resistance, and the spark plug, which includes the intermediate member, also exhibits improved durability and corrosion resistance.

APPLICATION EXAMPLE 2

In accordance with a second embodiment of the present invention, there is provided a spark plug according to application example 1, wherein, in the surface portion, the amount per unit volume of silicon (Si) is greater than that of aluminum (Al).

In the spark plug according to application example 2, there can be suppressed deterioration of the durability and corrosion resistance of the spark plug, which would be caused by formation of an intermetallic compound between aluminum (Al) and the noble metal in the intermediate member and/or caused by formation of aluminum nitride (AlN).

APPLICATION EXAMPLE 3

In accordance with a third embodiment of the present invention, there is provided a spark plug according to application examples 1 or 2, wherein the following relation is satisfied: $2.5 \leq Se/St$ wherein Se represents the area of a region formed by projection of the electrode-bonding portion on an imaginary plane parallel to a bonding surface between the electrode-bonding portion and the center electrode or the ground electrode, and St represents the transverse cross-sectional area of the tip-bonding portion. In the spark plug according to application example 3, heat transfer is likely to occur from the noble metal tip to at least one of the center electrode and the ground electrode via the intermediate member, and temperature elevation can be suppressed in the intermediate member. Therefore, metal diffusion can be suppressed in the intermediate member, and deterioration of the durability and corrosion resistance of the spark plug, which would otherwise be caused by metal diffusion, can be suppressed.

APPLICATION EXAMPLE 4

In accordance with a fourth embodiment of the present invention, there is provided a spark plug according to application example 3, wherein the transverse cross-sectional area St of the tip-bonding portion is 0.64 $mm^2$ or more.

In the spark plug according to application example 4, heat transfer is likely to occur from the noble metal tip to at least one of the center electrode and the ground electrode via the intermediate member, and temperature elevation can be suppressed in the intermediate member. Therefore, degradation of the noble metal tip, which would otherwise occur in association with use of the spark plug, can be suppressed, and the spark plug exhibits improved durability.

APPLICATION EXAMPLE 5

In accordance with a fifth embodiment of the present invention, there is provided a spark plug according to any of application examples 1 to 4, wherein the intermediate member contains iron (Fe) in an amount by weight of 500 ppm or less.

In the spark plug according to application example 5, the intermediate member contains substantially no iron (Fe). Therefore, even when the spark plug is subjected to repeated cooling-heating cycles, the spark plug can maintain its durability and corrosion resistance.

The present invention may be carried out in various modes other than those described above; for example, in a mode of a spark plug production method.

BRIEF DESCRIPTION OF THE DRAWINGS

FIGS. 3(A) and 3(B) are Tables showing specific conditions for preparing intermediate members (samples), and the results of evaluation of the intermediate members.

FIG. 4 shows the results of a test for determining the effect of Se/St.

FIGS. 5(A) and 5(B) show an intermediate member which has undergone cooling-heating cycles, wherein FIG. 5(A) is an image of an actual intermediate member, and FIG. 5(B) is a graphic illustration of the image of FIG. 5(A).

DETAILED DESCRIPTION OF PREFERRED EMBODIMENTS

A. Structure of Spark Plug

Figure 1:
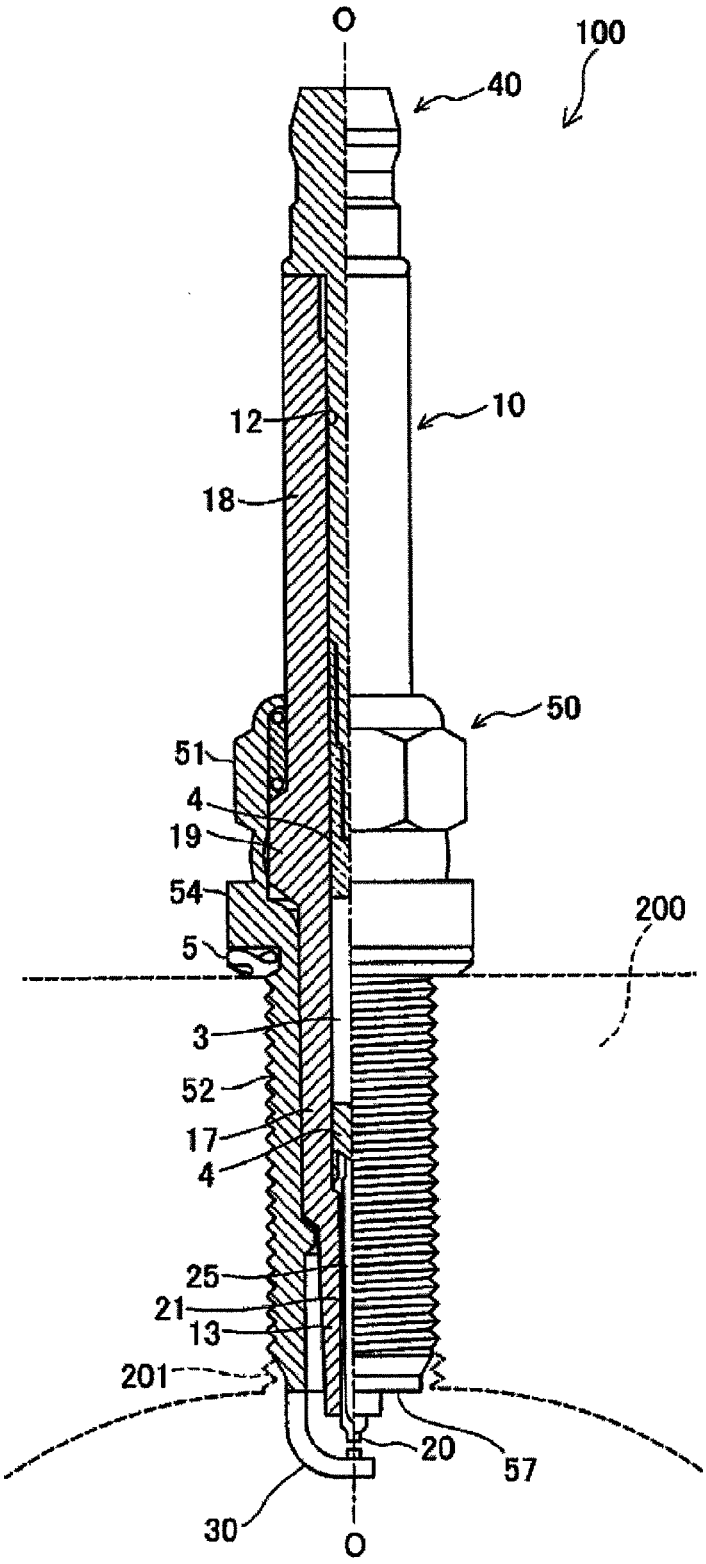
FIG. 1 is a partial cross-sectional view of a spark plug 100.

FIG. 1 is a partial cross-sectional view of a spark plug 100, illustrating one embodiment of the present invention. The spark plug 100 includes an insulator 10, a center electrode 20, a ground electrode 30, a metal terminal 40, and a metallic shell 50. The rod-like center electrode 20, which projects from one end of the insulator 10, extends through the interior of the insulator 10 and is electrically connected to the metal terminal 40 provided at the other end of the insulator 10. The outer periphery of the center electrode 20 is held by the insulator 10, and the outer periphery of the insulator 10 is held by the metallic shell 50, which is located away from the metal terminal 40. The ground electrode 30, which is electrically connected to the metallic shell 50, forms a spark gap (i.e., a gap for generating a spark) between the ground electrode 30 and the front end of the center electrode 20. The spark plug 100 is attached, via the metallic shell 50, to a threaded attachment hole 201 provided in an engine head 200 of an internal combustion engine. When a high voltage of 20,000 to 30,000 V is applied to the metal terminal 40, a spark is generated at the spark gap formed between the center electrode 20 and the ground electrode 30.

The insulator 10 is formed through firing of a ceramic material such as alumina. The insulator 10 is a cylindrical member having, in the center thereof, an axial hole 12 in which the center electrode 20 and the metal terminal 40 are accommodated. The insulator 10 has a middle body portion 19 which has a large outer diameter and is provided at the middle of the insulator in an axial direction. A rear-end-side body portion 18 for achieving insulation between the metal terminal 40 and the metallic shell 50 is provided on the side of the metal terminal 40 with respect to the middle body portion 19. A front-end-side body portion 17 having an outer diameter smaller than that of the rear-end-side body portion 18 is provided on the side of the center electrode 20 with respect to the middle body portion 19. Furthermore, an elongated leg portion 13 is provided at the front end of the front-end-side body portion 17. The elongated leg portion 13 has an outer diameter which is smaller than that of the front-end-side body portion 17, and which decreases toward the side of the center electrode 20.

The metallic shell 50 is a cylindrical shell for surrounding and holding a portion of the rear-end-side body portion 18 to the elongated leg portion 13 of the insulator 10. In the present embodiment, the metallic shell 50 is formed of low-carbon steel. The metallic shell 50 includes a tool engagement portion 51, a threaded attachment portion 52, and a sealing portion 54. The tool engagement portion 51 of the metallic shell 50 is fitted with a tool (not illustrated) for attaching the spark plug 100 to the engine head 200. The threaded attachment portion 52 of the metallic shell 50 has a thread which is screwed into the threaded attachment hole 201 of the engine head 200. The sealing portion 54 of the metallic shell 50 is formed at the base of the threaded attachment portion 52 so as to assume a flange-like shape, and a circular gasket 5 formed through bending of a plate is inserted between the sealing portion 54 and the engine head 200. The front end surface 57 of the metallic shell 50 has a hollow circular shape, and, at the center thereof, the center electrode 20 projects from the elongated leg portion 13 of the insulator 10.

The center electrode 20, which is a rod-like member, includes a bottomed cylindrical electrode matrix 21, and a core 25 which is embedded in the electrode matrix 21 and has thermal conductivity higher than that of the electrode matrix 21. In the present embodiment, the electrode matrix 21 is formed of a nickel alloy containing nickel as a main component, and the core 25 is formed of copper or an alloy containing copper as a main component. The center electrode 20 is inserted into the axial hole 12 of the insulator 10 such that the front end of the electrode matrix 21 projects from the axial hole 12 of the insulator 10, and the center electrode 20 is electrically connected to the metal terminal 40 via a ceramic resistor 3 and a sealing body 4.

B. Structure of Ground Electrode

Figure 2:
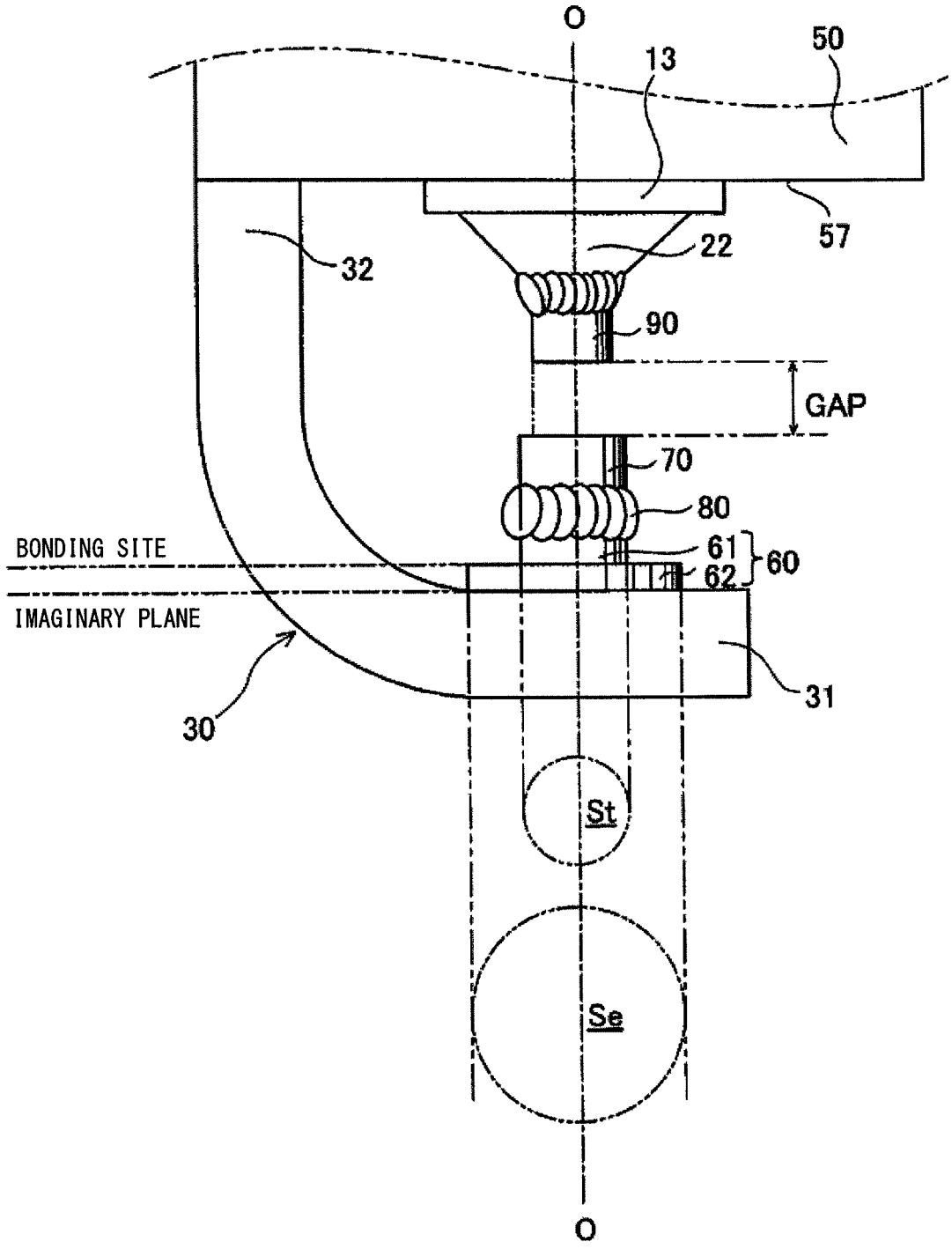
FIG. 2 is an enlarged explanatory view of a distal end portion of a ground electrode 30.

FIG. 2 is an enlarged explanatory view of a distal end portion of the ground electrode 30. The proximal portion 32 of the ground electrode 30 is bonded to the front end surface 57 of the metallic shell 50. The ground electrode 30 is bent so as to cross with the direction of an axis O; i.e., the direction in which the center electrode 20 extends. With respect to the axis O, the inner surface of the distal end portion 31 of the ground electrode 30 faces a center electrode tip 90 welded to the center electrode 20. The ground electrode 30 is formed of a metal having high corrosion resistance; for example, a nickel alloy such as Inconel (registered trademark) 600 or 601.

An intermediate member 60 having corrosion resistance is connected to a side surface of the distal end portion 31 of the ground electrode 30, the side surface facing the front end portion 22 of the center electrode 20 with respect to the axis O. The intermediate member 60 includes a tip-bonding portion 61 to which a ground electrode tip 70 is welded, and an electrode-bonding portion 62 which is provided adjacent to the tip-bonding portion 61 (i.e., stacked on the tip-bonding portion 61), and which is welded to the ground electrode 30. The cross section of the electrode-bonding portion 62 perpendicular to the axis O (hereinafter the cross section may be referred to as "transverse cross section") has an area greater than the transverse cross-sectional area of the tip-bonding portion 61. In the present embodiment, each of the tip-bonding portion 61 and the electrode-bonding portion 62 has a generally circular columnar shape; i.e., the transverse cross-sectional diameter (hereinafter the transverse cross-sectional diameter may be referred to simply as "diameter") is almost uniform in the entirety of each of the portions 61 and 62. The electrode-bonding portion 62 has a diameter greater than that of the tip-bonding portion 61; i.e., the electrode-bonding portion 62 is radially enlarged with respect to the tip-bonding portion 61 so as to assume a flange-like shape. The intermediate member 60 having the aforementioned shape may be formed through any known technique, such as machining. In the present embodiment, the intermediate member 60 is formed through plastic processing (header processing).

Before discussing the welding of the ground electrode tip 70 or the ground electrode 30, it should be pointed out that each of the tip-bonding portion 61 and the electrode-bonding portion 62 of the intermediate member 60 does not necessarily strictly need to have a circular columnar shape; i.e., a circular flat end surface. For example, a protrusion may be provided on the surface of the electrode-bonding portion 62 which is welded to the ground electrode 30. Each of the tip-bonding portion 61 and the electrode-bonding portion 62 forming the intermediate member 60, the ground electrode tip 70, and the center electrode tip 90 may assume a shape other than a circular columnar shape; for example, a rectangular columnar shape.

Preferably, the tip-bonding portion 61 has a diameter greater than the transverse cross-sectional diameter of the ground electrode tip 70 so as to secure a sufficient bonding strength between the tip-bonding portion 61 and the ground electrode tip 70. In order to secure uniform flame propagation, the tip-bonding portion 61, which is provided in the vicinity of the spark gap, preferably has a small size; i.e., the tip-bonding portion 61 preferably has a small diameter. Therefore, in the present embodiment, the tip-bonding portion 61 is formed so as to have a diameter nearly equal to that of the ground electrode tip 70.

The reason why the electrode-bonding portion 62 is formed so as to have a diameter greater than that of the tip-bonding portion 61 is to facilitate welding of the intermediate member 60 to the ground electrode 30, and to enhance the bonding strength between the intermediate member 60 and the ground electrode 30 for improving bonding reliability. Also, in the present embodiment, the corrosion resistance of the intermediate member 60 is improved by adjusting the ratio of the transverse cross-sectional area Se (see FIG. 2) of the electrode-bonding portion 62 to the transverse cross-sectional area St (see FIG. 2) of the tip-bonding portion 61 to 2.5 or more ($2.5 \leq Se/St$). The transverse cross-sectional area Se of the electrode-bonding portion 62 may also be referred to as "the area of a region formed by projection of the electrode-bonding portion 62 on an imaginary plane (see FIG. 2) parallel to the bonding surface between the electrode-bonding portion 62 and the ground electrode 30." In the case where the intermediate member 60 is formed through plastic processing as described above, the transverse cross-sectional area of the tip-bonding portion 61 may be slightly increased in the vicinity of the boundary between the tip-bonding portion 61 and the electrode-bonding portion 62. Therefore, in the present embodiment, the transverse cross-sectional area St of the tip-bonding portion 61 corresponds to the transverse cross-sectional area of a region having a uniform diameter. Hereinbelow will be described in detail the effect of improving the corrosion resistance of the intermediate member 60 by adjusting the ratio of the transverse cross-sectional area Se of the electrode-bonding portion 62 to the transverse cross-sectional area St of the tip-bonding portion 61 to the aforementioned value.

In the case where the intermediate member 60 is formed through plastic processing as described above, the percent processing increases as the diameter of the electrode-bonding portion 62 increases, and thus cracking is likely to occur in the electrode-bonding portion 62 during processing. Therefore, in consideration of processing accuracy, yield, etc., preferably, the maximum value of the ratio of the transverse cross-sectional area Se of the electrode-bonding portion 62 to the transverse cross-sectional area St of the tip-bonding portion 61 is adjusted to 3.5 ($Se/St \leq 3.5$).

Also, in the present embodiment, the durability of the ground electrode tip 70 is improved by achieving the relation: $2.5 \leq Se/St$, and adjusting the transverse cross-sectional area St of the tip-bonding portion 61 to 0.64 $mm^2$ or more. Hereinbelow will be described in detail the effect of improving the durability of the ground electrode tip 70 by adjusting the transverse cross-sectional area St of the tip-bonding portion 61 to the aforementioned value.

The intermediate member 60 is formed of, for example, a nickel alloy containing nickel (Ni) as a main component, and also containing at least chromium (Cr), silicon (Si), and aluminum (Al). More specifically, the intermediate member 60 contains chromium (Cr) in an amount of 15 to 25 wt. %, silicon (Si) in an amount (by weight) per unit volume of 0.04 $mg/mm^3$ to 0.12 $mg/mm^3$, and aluminum (Al) in an amount (by weight) per unit volume of 0.03 $mg/mm^3$ to 0.10 $mg/mm^3$. In the present embodiment, the entire intermediate member 60 has a uniform composition. Particularly preferably, the silicon (Si) content per unit volume of the intermediate member is greater than the aluminum (Al) content per unit volume thereof. When the intermediate member 60 has the aforementioned composition, the intermediate member 60 exhibits improved corrosion resistance. The relationship between the composition of the intermediate member 60 and the corrosion resistance thereof will be described hereinbelow in detail. The amount per unit volume of each component contained in the intermediate member may be determined, for example, as follows. Specifically, a sample having a specific size (e.g., 2 mm×2 mm) is obtained from the intermediate member (i.e., measurement target) through cutting, and the weight of the thus-cut sample is measured, to thereby determine the density of the intermediate member. The thus-cut sample is subjected to quantitative analysis by means of an EPMA (electron probe microanalyzer), to thereby determine the concentration (wt. %) of each component (element) forming the intermediate member (measurement target). The amount per unit volume of each component can be calculated by multiplying the above-determined density by the concentration of the component.

Preferably, the intermediate member 60, which is formed of an alloy, contains substantially no iron (Fe). However, even in the case where iron (Fe) is not intentionally added during production of the intermediate member 60, when a material forming the intermediate member 60 contains iron (Fe) as an impurity, iron (Fe) is inevitably incorporated into the intermediate member 60. In consideration of such inevitable incorporation of iron (Fe), preferably, the amount (by weight) of iron (Fe) contained in the intermediate member 60 is adjusted to 500 ppm or less.

Bonding between the intermediate member 60 and the ground electrode tip 70 may be carried out through, for example, fusion welding. Specifically, in the present embodiment, laser welding is carried out. Through fusion welding between the ground electrode tip 70 and the intermediate member 60, a fusion portion 80 is formed at the boundary between them. Bonding between the intermediate member 60 and the ground electrode 30 may be carried out through, for example, pressure welding. Specifically, in the present embodiment, resistance welding is carried out.

The ground electrode tip 70 is a member provided for the purpose of improving the spark erosion resistance of the ground electrode 30, and is a noble metal tip containing, as a main component, a noble metal having a high melting point. The ground electrode tip 70 may be formed of, for example, platinum (Pt), iridium (Ir), ruthenium (Ru), rhodium (Rh), or an alloy thereof. In the present invention, the ground electrode tip 70 is formed of a Pt—Rh alloy. The ground electrode tip 70 is formed so as to assume a generally circular columnar shape. As described above, the transverse cross-sectional diameter of the ground electrode tip 70 is almost equal to that of the tip-bonding portion 61.

C. Improvement of Durability and Corrosion Resistance of Spark Plug 100

C-1. Composition of Intermediate Member 60

In the case of a chromium (Cr)-containing nickel (Ni) alloy such as Inconel (registered trademark) alloy, invasion of oxygen into the alloy is suppressed through formation of a chromium oxide coating film on the surface thereof, whereby high corrosion resistance is achieved. When the intermediate member 60 is formed of such a chromium-containing nickel alloy, the corrosion resistance of the intermediate member 60 can be improved. However, the intermediate member 60 is subjected to cooling-heating cycles (i.e., repeated temperature elevation and lowering) in association with repeated ignition of the spark plug. When the intermediate member 60 undergoes repeated expansion and contraction through such cooling-heating cycles, the chromium oxide coating film formed on the surface of the intermediate member 60 is damaged due to expansion and contraction, and oxygen may invade into the intermediate member 60, resulting in progress of corrosion of the intermediate member 60. When the vicinity of the intermediate member 60 is exposed to a high-temperature environment, metal diffusion proceeds in the intermediate member 60 or in the ground electrode tip 70 adjacent thereto, and an intermetallic compound or the like is formed in the member in which metal diffusion has proceeded. Thus, corrosion of the intermediate member 60 further proceeds through formation of such an intermetallic compound or the like therein.

When the intermediate member 60 of the present embodiment is formed through plastic processing as described above, in the interior of the intermediate member 60, residual strain exists at the site of bonding (i.e., joint) between the tip-bonding portion 61 and the electrode-bonding portion 62, and residual stress occurs at the bonding site. The progress of corrosion is promoted at a site where residual stress occurs, as compared with a site where residual stress does not occur. Therefore, when the chromium oxide coating film covering the surface of the aforementioned bonding site (joint) is damaged, corrosion proceeds from the damaged portion, and a portion of the intermediate member 60 (tip-bonding portion 61) may be removed (i.e., separated) from the bonding site. Thus, when corrosion of the intermediate member 60 progressed, ultimately, the ground electrode tip 70, which is bonded to the intermediate member 60, may be removed (i.e., become separated) therefrom. Therefore, suppression of corrosion of the intermediate member 60 is important for prolonging the service life of the spark plug 100.

In the present embodiment, as described above, the intermediate member 60 contains silicon (Si) in an amount per unit volume of 0.04 $mg/mm^3$ to 0.12 $mg/mm^3$ and aluminum (Al) in an amount per unit volume of 0.03 $mg/mm^3$ to 0.10 $mg/mm^3$. Thus, since the intermediate member 60 contains, in a surface portion thereof, specific amounts of silicon (Si) and aluminum (Al), a layer of an alumina-silica mixture (hereinafter may be referred to simply as "mixture layer") is formed inside of the chromium oxide coating film at the surface portion of the intermediate member 60. Conceivably, improvement of the durability of the intermediate member 60 in the present embodiment is attributed to the fact that the mixture layer formed inside of the chromium oxide coating film exhibits the effect of reinforcing the chromium oxide coating film and suppressing damage to the film (i.e., anchoring effect). Therefore, conceivably, even when the intermediate member 60 is subjected to cooling-heating cycles, expansion/contraction and damage of the chromium oxide film are suppressed, resulting in improvement of durability.

The greater the amounts of silicon (Si) and aluminum (Al) contained in a surface portion of the intermediate member 60, the greater the amount (thickness) of the mixture layer formed at the surface of the intermediate member 60. Therefore, in order to obtain sufficient effects through formation of the mixture layer, preferably, the silicon (Si) content per unit volume of the intermediate member 60 is adjusted to 0.04 $mg/mm^3$ or more, and the aluminum (Al) content per unit volume of the intermediate member 60 is adjusted to 0.03 $mg/mm^3$ or more.

Meanwhile, when the aluminum (Al) content of the intermediate member 60 is excessively high, an intermetallic compound is likely to be formed between aluminum (Al) and a noble metal diffused from the ground electrode tip 70 or the fusion portion 80 (e.g., platinum (Pt) or iridium (Ir)) at a site where aluminum (Al) is present (e.g., at the surface portion of the intermediate member 60). Since the thus-formed intermetallic compound is harder and more brittle than the nickel alloy forming the intermediate member 60, formation of the intermetallic compound may cause deterioration of the strength and durability of the intermediate member 60. Therefore, when aluminum (Al) is caused to be present at least at the surface portion of the intermediate member 60, preferably, the aluminum (Al) content per unit volume of the intermediate member 60 is adjusted to 0.10 $mg/mm^3$ or less, in order to suppress corrosion of the intermediate member 60 and to improve the durability thereof.

When the silicon (Si) content of the intermediate member 60 is excessively high, a eutectic structure is likely to be formed between silicon (Si) and a noble metal diffused from the ground electrode tip 70 or the fusion portion 80 (e.g., platinum (Pt)) at a site where silicon (Si) is present (e.g., at the surface portion of the intermediate member 60). The thus-formed eutectic structure has a melting point lower than that of the nickel alloy, and, upon use of the spark plug 100, the temperature of the intermediate member 60 may become higher than the melting point of the eutectic structure. When the temperature of the intermediate member 60 becomes higher than the melting point of the eutectic structure, the eutectic structure may liquefy in the intermediate member 60, resulting in deterioration of the strength and durability of the intermediate member 60. In addition, when the silicon (Si) content of the intermediate member 60 is high, the silicon (Si) content of the fusion portion 80 also increases, resulting in an increase in amount of silicon (Si) which diffuses in the ground electrode tip 70. Thus, an increasing amount of a low-melting-point eutectic structure is formed between silicon (Si) and a noble metal (e.g., platinum (Pt)) in the ground electrode tip 70 or the fusion portion 80, and spark erosion resistance is impaired. Therefore, when silicon (Si) is caused to be present at least at the surface portion of the intermediate member 60, preferably, the silicon (Si) content of the intermediate member 60 is adjusted to 0.12 mg/mm$^3$ or less, in order to improve the durability of the intermediate member 60.

In the case where the intermediate member 60 contains aluminum (Al) and silicon (Si), when the amount by mole of aluminum (Al) is nearly equal to that of silicon (Si), a ternary intermetallic compound of aluminum (Al), silicon (Si), and a noble metal (e.g., Pt) is likely to be segregated. Segregation of such an intermetallic compound may progress corrosion of the intermediate member 60. Therefore, preferably, the amount by mole of aluminum (Al) is not equal to that of silicon (Si) in the intermediate member 60.

Furthermore, when the aluminum (Al) content of the intermediate member 60 is greater than the silicon (Si) content thereof, aluminum (Al) is likely to react with nitrogen which has passed through the chromium oxide coating film, to thereby form aluminum nitride (AlN). When aluminum nitride (AlN) is formed in the intermediate member 60, cracks may be generated in the intermediate member 60, and elongation of cracks may occur therein, resulting in progress of corrosion. In the case where an alumina-silica mixture layer is formed, when the aluminum (Al) content of the intermediate member 60 is higher, the alumina content of the mixture layer becomes higher, whereas when the silicon (Si) content of the intermediate member 60 is higher, the silica content of the mixture layer becomes higher. Since the nitrogen impermeability of silica is superior to that of alumina, when the silica content of the mixture layer is increased by increasing the silicon (Si) content of the intermediate member 60, the ability of the intermediate member 60 to block nitrogen can be enhanced. Thus, when the ability of the intermediate member 60 to block nitrogen is enhanced, formation of aluminum nitride (AlN) can be suppressed, and corrosion resistance can be improved. Therefore, at least, the silicon (Si) content per unit volume of the intermediate member 60 is preferably adjusted to be higher than the aluminum (Al) content per unit volume thereof.

Aluminum (Al) has an atomic weight of 27.0, and silicon (Si) has an atomic weight of 28.1. That is, when the silicon (Si) content per unit volume of the intermediate member is adjusted to be 1.04 times the aluminum (Al) content per unit volume thereof, the amount by mole of silicon (Si) becomes equal to that of aluminum (Al). Therefore, preferably, the silicon (Si) content per unit volume of the intermediate member is adjusted to be more than 1.04 times the aluminum (Al) content per unit volume thereof.

C-2. Configuration of Intermediate Member 60

As shown in FIG. 2, the intermediate member 60 has such a configuration that the ratio of the transverse cross-sectional area Se of the electrode-bonding portion 62 to the transverse cross-sectional area St of the tip-bonding portion 61 is 2.5 or more (2.5≤Se/St). With this configuration, the temperature elevation of the intermediate member 60 is suppressed, and the corrosion resistance of the intermediate member 60 is improved. In addition, in the intermediate member 60, the ratio Se/St is adjusted to fall within the above range, and the transverse cross-sectional area St of the tip-bonding portion 61 is adjusted to 0.64 mm$^2$ or more. Next will be described improvement of the durability and corrosion resistance of the intermediate member 60 with the aforementioned configuration.

Since the nickel-chromium alloy forming the intermediate member 60 has a thermal conductivity lower than that of the noble metal forming the ground electrode tip 70, heat transfer is less likely to occur from the ground electrode tip 70 to the ground electrode 30 via the intermediate member 60. When heat cannot be transferred to the ground electrode 30, the temperature of the intermediate member 60 or the fusion portion 80 becomes higher, and thus metal diffusion is likely to occur. When metal diffusion proceeds, as described above, an increasing amount of an intermetallic compound or a eutectic structure is formed, and the durability and corrosion resistance of the intermediate member 60 are impaired. Particularly, in the case of the present embodiment, in which the intermediate member 60 is produced through plastic processing, and residual stress occurs in the vicinity of the bonding site between the tip-bonding portion 61 and the electrode-bonding portion 62, durability is likely to be impaired in the vicinity of the bonding site. In the present embodiment, the contact area between the electrode-bonding portion 62 and the ground electrode 30 is increased by adjusting the ratio Se/St to fall within the aforementioned range, so that heat is likely to be transferred to the ground electrode 30 via the intermediate member 60. When such heat transfer is likely to occur, temperature elevation can be suppressed in the intermediate member 60, and progress of corrosion of the intermediate member 60, which would otherwise be caused by cooling-heating cycles, can be suppressed. In addition, in the present embodiment, heat is likely to be transferred from the ground electrode tip 70 to the ground electrode 30 via the tip-bonding portion 61 by adjusting the transverse cross-sectional area St of the tip-bonding portion 61 to fall within the aforementioned range. Thus, when heat is likely to be transferred from the ground electrode tip 70 to the ground electrode 30, the temperature elevation of the ground electrode tip 70 in association with ignition of the spark plug can be suppressed, and the deterioration over time of the ground electrode tip 70, which would otherwise be caused by temperature elevation, can be suppressed.

EXAMPLES

A plurality of intermediate members (samples) were prepared under the same conditions, except for aluminum (Al) content per unit volume, silicon (Si) content per unit volume, and Se/St. The durability and corrosion resistance of each of the thus-prepared intermediate members were evaluated. FIG. 3 shows specific conditions for preparing the intermediate members (samples), as well as the evaluation results of the samples. FIG. 3(A) summarizes the results of samples 1 to 9 in which, while Se/St was maintained constant, aluminum (Al) content and silicon (Si) content were varied for determining the effects of Al content and Si content. FIG. 3(B) summarizes the results of samples 3 to 5 and 10 to 13 in which, while Al content and Si content were maintained constant, Se/St was varied for determining the effect of Se/St.

Each intermediate member (sample) was formed from a nickel alloy containing nickel (Ni) in an amount of about 73 wt. % and chromium (Cr) in an amount of 25 wt. %. A noble metal tip (ground electrode tip) formed of platinum (Pt) and having the same size (transverse cross-sectional diameter: 0.7 mm) was welded to each intermediate member (sample). When Se/St was varied, the diameter of a tip-bonding portion was maintained constant (diameter: 0.7 mm, St=0.38 $mm^2$) in the respective intermediate members (samples), and the diameter of an electrode-bonding portion was varied therein.

FIG. 4 summarizes the results of samples 14 to 16 in which, as in the case of the samples shown in FIG. 3(B), while Al content and Si content were maintained constant, Se/St was varied for determining the effect of Se/St. As shown in FIG. 4, the noble metal tip (ground electrode tip) formed of platinum (Pt) and the tip-bonding portion have transverse cross-sectional diameters different from those shown in FIG. 3. As shown in FIG. 4, while the transverse cross-sectional diameters of the noble metal tip and the tip-bonding portion were maintained at 0.95 mm (St=0.71 $mm^2$), Se/St was varied by changing the diameter of the electrode-bonding portion (i.e., by changing Se).

Figure 5A:
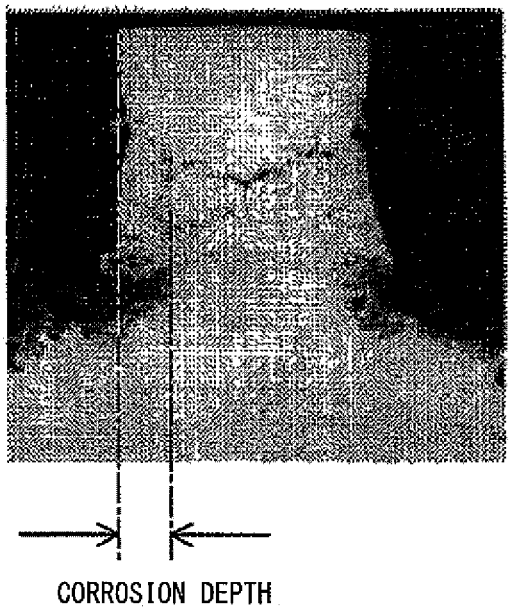
Figure 5B:
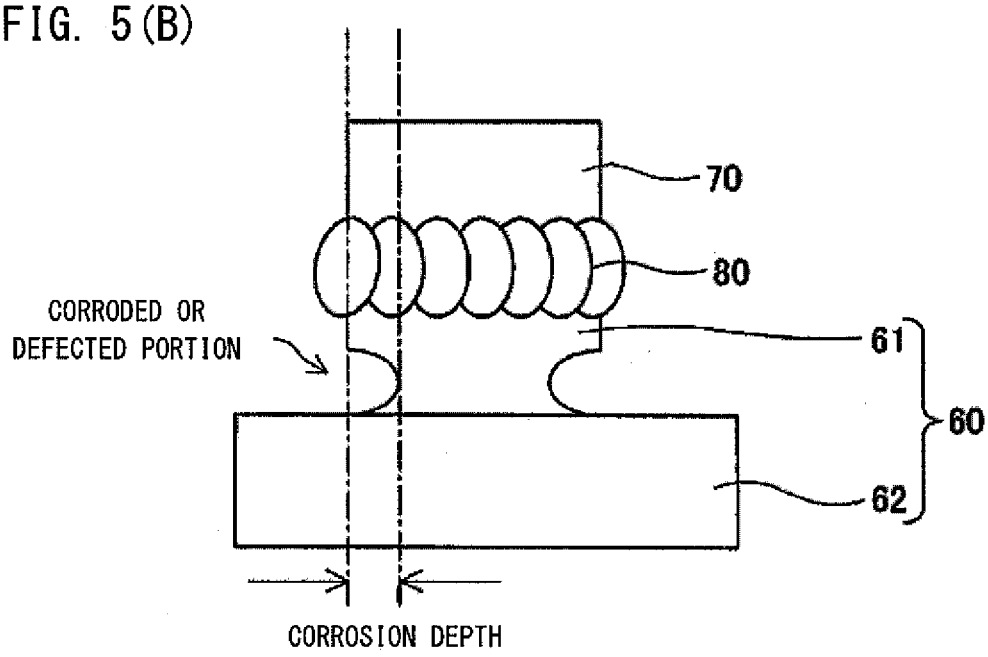

The durability and corrosion resistance of each intermediate member (sample) were evaluated as follows. Specifically, each intermediate member (sample) was subjected to 5,000 cooling-heating cycles, each cycle including heating by means of a gas burner at 1,200° C. and stop of the heating, and then a cross section of the intermediate member was observed. FIGS. 5(A) and 5(B) show an intermediate member which was subjected to the aforementioned cooling-heating cycles. FIG. 5(A) is an actual photograph of a cross section of an intermediate member which was subjected to the aforementioned cooling-heating cycles. FIG. 5(B) schematically shows an intermediate member in which corrosion or defect occurred through the cooling-heating cycles. As shown in FIGS. 5(A) and 5(B), when corrosion or detect occurs in an intermediate member through cooling-heating cycles, corrosion or defect generally proceeds at the bonding site between the electrode-bonding portion 62 and the tip-bonding portion 61 at which residual stress occurs. Therefore, for evaluation of the durability and corrosion resistance of each intermediate member, by use of a photographed cross section thereof, the depth of a corroded or defected portion was measured from the corresponding side surface of the noble metal tip 70 (hereinafter the depth may be referred to as "corrosion depth") (see FIGS. 5(A) and 5(B)). The durability and corrosion resistance of each sample were evaluated on the basis of the thus-measured corrosion depth. In the evaluation results shown in FIGS. 3 and 4, the symbol "$O^{++}$" corresponds to a corrosion depth of less than 0.05 mm; the symbol "$O^{+}$" corresponds to a corrosion depth of 0.05 mm or more and less than 0.1 mm; the symbol "O" corresponds to a corrosion depth of 0.1 mm or more and less than 0.15 mm; and the symbol "X" corresponds to a corrosion depth of 0.15 mm or more.

In FIG. 3(A), a shaded value corresponds to the case where the aluminum (Al) content per unit volume of a sample falls outside a range of 0.03 $mg/mm^3$ to 0.10 $mg/mm^3$, or the silicon (Si) content per unit volume of a sample falls outside a range of 0.04 $mg/mm^3$ to 0.12 $mg/mm^3$. As shown in FIG. 3(A), when the aluminum (Al) content per unit volume of an intermediate member falls within a range of 0.03 $mg/mm^3$ to 0.10 $mg/mm^3$, and the silicon (Si) content per unit volume of the intermediate member falls within a range of 0.04 $mg/mm^3$ to 0.12 $mg/mm^3$, the intermediate member exhibits improved durability and corrosion resistance (e.g., comparison between samples 3 to 5, 7, and 8 and samples 1, 2, 6, and 9).

As shown in FIG. 3(A), in the case where the aluminum (Al) content per unit volume and silicon (Si) content per unit volume of an intermediate member respectively fall within the aforementioned ranges, when the silicon (Si) content per unit volume of the intermediate member is higher than the aluminum (Al) content per unit volume thereof, the intermediate member exhibits further improved durability and corrosion resistance. That is, among samples 1 to 9 in which Se/St is the same, sample 3, 7, 8, or 10 in which the silicon (Si) content per unit volume is higher than the aluminum (Al) content per unit volume exhibits more favorable durability and corrosion resistance, as compared with sample 4 or 5 in which the aluminum (Al) content per unit volume is higher than the silicon (Si) content per unit volume.

As shown in FIG. 3(B), when Se/St is 2.5 or more, the intermediate member exhibits improved durability and corrosion resistance (e.g., comparison between sample 3 and sample 10, between sample 4 and sample 11, or between sample 5 and sample 12 or sample 13). As shown in FIG. 4, in the case where Se/St is 2.5 or more, even when St (i.e., the transverse cross-sectional area of the tip-bonding portion) is changed (St=0.71 $mm^2$), the same effects as described above are achieved (comparison between sample 14 and sample 15 or 16).

Figures 6, 7:
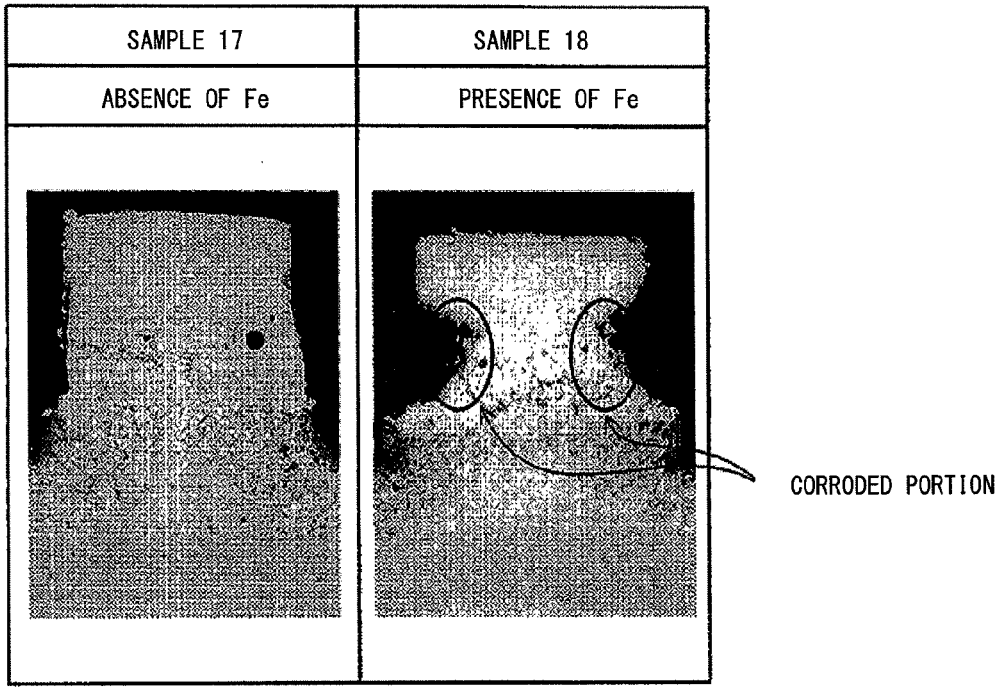
FIG. 6 shows images of two samples illustrating the results of a test for determining the effect of the presence or absence of iron (Fe).
FIG. 7 shows the results of a test for determining the effect of area St on durability.

FIG. 6 shows the results of a test for determining the effect of the presence or absence of iron (Fe) in an intermediate member on the durability and corrosion resistance of the intermediate member. As shown in FIG. 6, sample 17 corresponds to an intermediate member containing substantially no elemental iron (Fe) (500 ppm or less). Sample 18 corresponds to an intermediate member containing 1.4 wt. % elemental iron (Fe). The intermediate members (samples 17 and 18) were prepared under the same conditions, except for elemental iron (Fe) content. Specifically, each sample was formed from a nickel alloy containing nickel (Ni) in an amount of about 73 wt. %, chromium (Cr) in an amount of 25 wt. %, aluminum (Al) in an amount per unit volume of 0.05 $mg/mm^3$, and silicon (Si) in an amount per unit volume 0.08 $mg/mm^3$. In each of the intermediate members (samples 17 and 18), Se/St was adjusted to 2.6.

Each of the intermediate members (samples 17 and 18) and a noble metal tip formed of platinum (Pt) were attached to a ground electrode of a spark plug having the same configuration. The spark plug incorporating the intermediate member was attached to an engine having the same configuration (naturally aspirated 6-cylinder engine, 2,000 cc). Thereafter, the engine was operated in the same manner as in the case where an automobile was operated for repeated cycles, each including full-throttle acceleration and idling. The aforementioned operation cycles were repeated for 100 hours, and then the spark plug was removed from the engine. Subsequently, a cross section of the intermediate member attached to the spark plug was observed in the same manner as shown in FIG. 5(A).

As shown in FIG. 6, virtually no corrosion or defect occurred in the intermediate member (sample 17) containing substantially no elemental iron (Fe). In contrast, in the intermediate member (sample 18) containing elemental iron (Fe), corrosion or defect occurred at the entire side surfaces of the tip-bonding portion (i.e., from the fusion portion, which is the boundary between the intermediate member and the noble metal tip, to the bonding site between the tip-bonding portion and the electrode-bonding portion). These data indicate that when an intermediate member contains substantially no elemental iron (Fe), the intermediate member exhibits further improved durability and corrosion resistance, and also the entire spark plug exhibits further improved durability and corrosion resistance.

FIG. 7 shows the results of a test for determining the effect of the transverse cross-sectional area St of a tip-bonding portion on the durability of a noble metal tip by varying the transverse cross-sectional area St of the tip-bonding portion while maintaining the composition of an intermediate member constant and attaining the relation 2.5≤Se/St. Specifically, FIG. 7 shows data (in terms of gap increase) of samples 19 to 23 prepared by varying the transverse cross-sectional area St of a tip-bonding portion while maintaining the transverse cross-sectional area Se of an electrode-bonding portion constant (Se=2.0 $mm^2$, transverse cross-sectional diameter of the electrode-bonding portion: 1.6 mm). Each sample (intermediate member) was formed from a nickel alloy containing nickel (Ni) in an amount of about 73 wt. %, chromium (Cr) in an amount of 25 wt. %, and substantially no elemental iron (Fe). The aluminum (Al) content per unit volume and silicon (Si) content per unit volume of each sample were adjusted to 0.075 $mg/mm^3$ and 0.083 $mg/mm^3$, respectively. In each sample, the transverse cross-sectional diameter of the tip-bonding portion shown in FIG. 7 was equal to that of the noble metal tip. FIG. 7 also shows Se/St in each sample. As shown in FIG. 7, Se/St was adjusted to 2.5 or more in each sample.

"Gap increase" shown in FIG. 7 corresponds to an increase in spark gap of a spark plug. In this test, a spark plug incorporating each sample was subjected to spark discharge treatment in a nitrogen atmosphere (pressure: 1.2 MPa) at 100 Hz for 200 hours. Thereafter, the distance of the spark gap of the spark plug was measured by means of a pin gauge. In each sample, the spark gap was 1.05 mm before the aforementioned treatment. "Gap increase (mm)" shown in FIG. 7 corresponds to the difference between the spark gap as measured before the treatment and the spark gap as measured after the aforementioned treatment.¥

Figure 8:
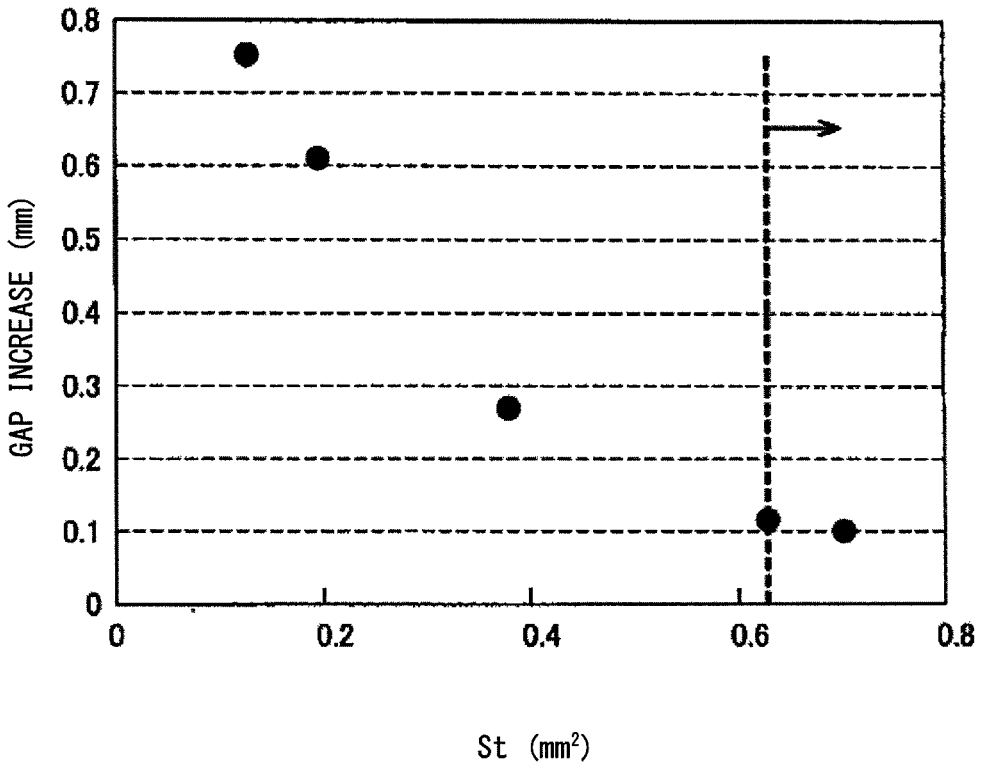
FIG. 8 is a graph showing the relationship between area St and gap increase.

FIG. 8 is a graph showing the relationship between the transverse cross-sectional area St of a tip-bonding portion and gap increase. As is clear from the graph, the larger the transverse cross-sectional area St of a tip-bonding portion, the more suppressed the gap increase. As shown in FIG. 8, the effect of suppressing gap increase by increasing the transverse cross-sectional area St of a tip-bonding portion is not pronounced when the transverse cross-sectional area St of the tip-bonding portion becomes 0.64 $mm^2$ or more. The broken line shown in FIG. 8 corresponds to a point where the transverse cross-sectional area St of the tip-bonding portion is 0.64 $mm^2$. These data indicate that when the transverse cross-sectional area St of the tip-bonding portion is 0.64 $mm^2$ or more, the effect of suppressing gap increase is pronounced. Thus, these data indicate the durability of the spark plug can be improved by achieving the relation: 2.5≤Se/St, and adjusting the transverse cross-sectional area St of the tip-bonding portion to 0.64 $mm^2$ or more. The expression "the transverse cross-sectional area St of a tip-bonding portion is 0.64 $mm^2$ or more" includes the case where when the transverse cross-sectional area St of a tip-bonding portion is rounded off to two decimal places, the value 0.64 $mm^2$ is obtained.

D. Modifications

The present invention is not limited to the aforementioned examples and embodiments, and various other embodiments may be implemented without departing from the scope of the invention. For example, the below-described modifications may be carried out.

D1. Modification 1

In the aforementioned embodiments, the silicon (Si) and aluminum (Al) contents per unit volume of the intermediate member 60 are uniform throughout the member 60. However, the silicon (Si) or aluminum (Al) content per unit volume of the intermediate member 60 may be non-uniform therein, so long as the silicon (Si) and aluminum (Al) contents per unit volume of the intermediate member 60 fall within the aforementioned ranges at least in a surface portion of the member 60. As described above, the effect obtained by adjusting the silicon (Si) and aluminum (Al) contents per unit volume of the intermediate member to fall within specific ranges is attributed to the fact that an alumina-silica mixture layer is formed inside of a chromium oxide coating film formed at the surface of the intermediate member. Therefore, the silicon (Si) or aluminum (Al) content per unit volume of the intermediate member may be non-uniform therein, so long as the silicon (Si) and aluminum (Al) contents per unit volume of the intermediate member fall within the aforementioned ranges in a surface portion thereof in which an alumina-silica mixture layer can be formed through migration of silicon (Si) and aluminum (Al) toward the surface by metal diffusion (e.g., at least a portion having a thickness of 200 μm as measured from the surface).

For production of an intermediate member in which the composition of a surface portion differs from that of another portion (center portion), for example, a circular columnar member having, at the center thereof, a through-hole extending in a height direction (member corresponding to the surface portion) may be provided, and a circular columnar member corresponding to the center portion may be pressed into the through-hole, or a material forming the center portion may be charged into the through-hole. Alternatively, a circular columnar member corresponding to the center portion may be provided, and a metal film having a composition corresponding to that of the surface portion may be formed on the side surface of the member through, for example, plating treatment. For production of an intermediate member having a structure including a tip-bonding portion and an electrode-bonding portion, a circular columnar member having the aforementioned dual structure may be subjected to plastic processing (header processing).

D2. Modification 2

In the embodiments described above, the intermediate member 60 is provided on the ground electrode 30. However, the present invention may be applied to the center electrode 20 in place of or in addition to the ground electrode 30. Specifically, an intermediate member having the same configuration as described in the embodiments may be provided between the center electrode 20 and the center electrode tip 90. Even in such a case, similar effects can be obtained through improvement of the durability and corrosion resistance of the intermediate member.

DESCRIPTION OF REFERENCE NUMERALS

3: ceramic resistor
4: sealing body
5: gasket
10: insulator
12: axial hole
13: elongated leg portion
17: front-end-side body portion
18: rear-end-side body portion
19: middle body portion
20: center electrode
21: electrode matrix

22: front end portion
25: core
30: ground electrode
31: distal end portion
32: proximal portion
40: metal terminal
50: metallic shell
51: tool engagement portion
52: threaded attachment portion
54: sealing portion
57: front end surface
60: intermediate member
61: tip-bonding portion
62: electrode-bonding portion
70: ground electrode tip
80: fusion portion
90: center electrode tip
100: spark plug
200: engine head
201: threaded attachment hole Having described the invention, the following is claimed:

1. A spark plug comprising:
a center electrode;
an insulator provided around the center electrode;
a metallic shell provided around the insulator; and
a ground electrode which is provided such that one end thereof is bonded to the metallic shell, and the other end faces the center electrode,
at least one of the center electrode and the ground electrode having thereon an intermediate member which connects the center electrode or the ground electrode to a noble metal tip;
the intermediate member having a tip-bonding portion to which the noble metal tip is bonded, and an electrode-bonding portion to which said one of the center electrode or the ground electrode is bonded, said electrode-bonding portion being adjacent to the tip-bonding portion and having a diameter greater than that of the tip-bonding portion;
the intermediate member containing nickel (Ni) as a main component, and also containing chromium (Cr) in an amount of 15 to 25 wt. %;
the intermediate member further containing, in a surface portion thereof, silicon (Si) in an amount per unit volume of 0.04 $mg/mm^3$ to 0.12 $mg/mm^3$, and aluminum (Al) in an amount per unit volume of 0.03 $mg/mm^3$ to 0.10 $mg/mm^3$,
wherein the following relation is satisfied: $2.5 \leq Se/St$ wherein Se represents the area of a region formed by projection of the electrode-bonding portion on an imaginary plane parallel to a bonding surface between the electrode-bonding portion and the ground electrode, and St represents the transverse cross-sectional area of the tip-bonding portion, and
wherein the transverse cross-sectional area St of the tip-bonding portion is 0.64 $mm^2$ or more.

2. A spark plug according to claim 1, wherein, in the surface portion, the amount per unit volume of silicon (Si) is greater than that of aluminum (Al).

3. A spark plug according to claim 2, wherein the intermediate member contains iron (Fe) in an amount by weight of 500 ppm or less.

4. A spark plug according to claim 1, wherein the intermediate member contains iron (Fe) in an amount by weight of 500 ppm or less.

5. A spark plug comprising:
a center electrode;
an insulator provided around the center electrode;
a metallic shell provided around the insulator; and
a ground electrode which is provided such that one end thereof is bonded to the metallic shell, and the other end faces the center electrode,
at least one of the center electrode and the ground electrode having thereon an intermediate member which connects the center electrode or the ground electrode to a noble metal tip;
the intermediate member having a tip-bonding portion to which the noble metal tip is bonded, and an electrode-bonding portion to which said one of the center electrode or the ground electrode is bonded, said electrode-bonding portion being adjacent to the tip-bonding portion and having a diameter greater than that of the tip-bonding portion;
the intermediate member containing nickel (Ni) as a main component, and also containing chromium (Cr) in an amount of 15 to 25 wt. %;
the intermediate member further containing, in a surface portion thereof, silicon (Si) in an amount per unit volume of 0.04 $mg/mm^3$ to 0.12 $mg/mm^3$, and aluminum (Al) in an amount per unit volume of 0.03 $mg/mm^3$ to 0.10 $mg/mm^3$,
wherein the surface portion separates the intermediate member from a chromium oxide layer covering the surface portion.

6. A spark plug according to claim 5, wherein the following relation is satisfied: $2.5 \leq Se/St$ wherein Se represents the area of a region formed by projection of the electrode-bonding portion on an imaginary plane parallel to a bonding surface between the electrode-bonding portion and the center electrode or the ground electrode, and St represents the transverse cross-sectional area of the tip-bonding portion.

7. A spark plug according to claim 6, wherein the transverse cross-sectional area St of the tip-bonding portion is 0.64 $mm^2$ or more.

8. A spark plug according to claim 7, wherein the intermediate member contains iron (Fe) in an amount by weight of 500 ppm or less.

9. A spark plug according to claim 6, wherein the intermediate member contains iron (Fe) in an amount by weight of 500 ppm or less.

10. A spark plug according to claim 5, wherein the surface portion separates the remaining portion of the intermediate member from a chromium oxide layer covering the surface portion.

11. A spark plug comprising:
a center electrode;
an insulator provided around the center electrode;
a metallic shell provided around the insulator; and
a ground electrode which is provided such that one end thereof is bonded to the metallic shell, and the other end faces the center electrode,
at least one of the center electrode and the ground electrode having thereon an intermediate member which connects the center electrode or the ground electrode to a noble metal tip;
the intermediate member having a tip-bonding portion to which the noble metal tip is bonded, and an electrode-bonding portion to which said one of the center electrode or the ground electrode is bonded, said electrode-bonding portion being adjacent to the tip-bonding portion and having a diameter greater than that of the tip-bonding portion;

the intermediate member containing nickel (Ni) as a main component, and also containing chromium (Cr) in an amount of 15 to 25 wt. %; and the intermediate member further containing, in a surface portion thereof, silicon (Si) in an amount per unit volume of 0.04 $mg/mm^3$ to 0.12 $mg/mm^3$, and aluminum (Al) in an amount per unit volume of 0.03 $mg/mm^3$ to 0.10 $mg/mm^3$, wherein an area Se of a region formed by projection of the electrode bonding portion on an imaginary plane parallel to a bonding surface between the electrode bonding portion and the ground electrode is 1.6 $mm^2$ or more.

12. A spark plug according to claim 11, wherein a transverse cross-sectional area St of the tip bonding portion is 0.64 $mm^2$ or more.

13. A spark plug according to claim 11, wherein the following relation is satisfied: $2.5 \leq Se/St$ wherein St represents a transverse cross-sectional area of the tip-bonding portion.

14. A spark plug comprising:

a center electrode;

an insulator provided around the center electrode;

a metallic shell provided around the insulator; and a ground electrode which is provided such that one end thereof is bonded to the metallic shell, and the other end faces the center electrode, at least one of the center electrode and the ground electrode having thereon an intermediate member which connects the center electrode or the ground electrode to a noble metal tip;

the intermediate member having a tip-bonding portion to which the noble metal tip is bonded, and an electrode-bonding portion to which said one of the center electrode or the ground electrode is bonded, said electrode-bonding portion being adjacent to the tip-bonding portion and having a diameter greater than that of the tip-bonding portion;

the intermediate member containing nickel (Ni) as a main component, and also containing chromium (Cr) in an amount of 15 to 25 wt. %;

the intermediate member further containing, in a surface portion thereof, silicon (Si) in an amount per unit volume of 0.04 $mg/mm^3$ to 0.12 $mg/mm^3$, and aluminum (Al) in an amount per unit volume of 0.03 $mg/mm^3$ to 0.10 $mg/mm^3$, wherein the following relation is satisfied: $2.5 \leq Se/St$, wherein Se represents a transverse cross-sectional area of the electrode bonding portion, and St represents the transverse cross-sectional area of the tip bonding portion, wherein St is 0.64 $mm^2$ or more.

* * * * *